US005692323A

United States Patent [19]

Goldberg

[11] Patent Number: 5,692,323

[45] Date of Patent: Dec. 2, 1997

[54] FOOTWEAR WITH AUTO-RETURNING TURNTABLE

[75] Inventor: Jack Goldberg, Toorak, Australia

[73] Assignee: Rotasole Pty. Ltd., East Brighton, Australia

[21] Appl. No.: 500,942

[22] PCT Filed: Jan. 4, 1994

[86] PCT No.: PCT/AU94/00002

§ 371 Date: Sep. 27, 1995

§ 102(e) Date: Sep. 27, 1995

[87] PCT Pub. No.: WO94/16588

PCT Pub. Date: Aug. 4, 1994

Related U.S. Application Data

[63] Continuation-in-part of Ser. No. 075,502, filed as PCT/AU91/00590, Dec. 20, 1991, Pat. No. 5,392,537.

[30] Foreign Application Priority Data

Jan. 26, 1993 [AU] Australia ..... PL6942

[51] Int. Cl.[6] ..... A43B 5/00

[52] U.S. Cl. ..... 036/134; 36/61; 36/115; 36/8.1

[58] Field of Search ..... 36/7.8, 8.3, 27, 36/114, 132, 134, 136, 8.1

[56] References Cited

U.S. PATENT DOCUMENTS

| | | | |
|---|---|---|---|
| 2,640,283 | 6/1953 | McCord | 36/31 X |
| 3,081,562 | 3/1963 | Oakley | 36/8.3 |
| 3,091,043 | 5/1963 | McCorkie | 36/115 X |
| 3,204,348 | 9/1965 | Latson | 36/136 X |
| 3,271,885 | 9/1966 | McAuliffe | 36/134 X |
| 3,481,332 | 12/1969 | Arnold . | |
| 3,707,047 | 12/1972 | Nedwick | 36/59 R X |
| 3,757,437 | 9/1973 | Cameron | 36/59 R |
| 3,824,710 | 7/1974 | Egtvedt | 36/134 |
| 4,035,934 | 7/1977 | Hrivnak | 36/134 X |
| 4,271,610 | 6/1981 | Parrent | 36/136 |
| 4,445,288 | 5/1984 | Frör | 36/134 |
| 4,457,084 | 7/1984 | Horibata et al. | 36/28 X |
| 4,541,185 | 9/1985 | Chou | 36/114 |
| 4,739,564 | 4/1988 | Eser | 36/134 X |
| 5,079,968 | 1/1992 | Starner | 74/534.6 |
| 5,243,776 | 9/1993 | Zelinko | 36/134 |
| 5,386,651 | 2/1995 | Okamoto | 36/134 |
| 5,392,537 | 2/1995 | Goldberg | 36/134 |
| 5,475,937 | 12/1995 | Korsen | 36/134 |

FOREIGN PATENT DOCUMENTS

| | | | |
|---|---|---|---|
| 69038 | 11/1975 | Australia . | |
| 53705/86 | 8/1986 | Australia . | |
| 34068/89 | 11/1989 | Australia . | |
| 1474358 | 2/1967 | France . | |
| 2565469 | 12/1985 | France . | |
| 229175 | 12/1910 | Germany | 36/61 |
| 1957191 | 6/1970 | Germany . | |
| 3622844 | 1/1988 | Germany . | |
| 1131803 | 10/1968 | United Kingdom . | |
| 1299448 | 12/1972 | United Kingdom . | |
| 1385617 | 2/1975 | United Kingdom . | |
| WO 87/06437 | 11/1987 | WIPO . | |
| WO 90/06700 | 6/1990 | WIPO . | |
| WO 92/10954 | 7/1992 | WIPO . | |

*Primary Examiner*—B. Dayoan

*Attorney, Agent, or Firm*—Knobbe, Martens, Olson & Bear LLP

[57] ABSTRACT

A turntable is provided for an article of footwear having a sole with a recess therein. The recess of the sole has a central hub, an arcuate lug and two locating lugs. A spring module is located in the recess and has a large aperture through which passes the hub. The turntable is located in the recess and has an arcuate recess in which the arcuate lug locates, a central opening in which the central hub locates, and an enlarged recess in which the spring module locates.

10 Claims, 1 Drawing Sheet

FOOTWEAR WITH AUTO-RETURNING TURNTABLE

This application is a 371 of PCT/AU94/00002, filed Jan. 4, 1994, which is a continuation in part application of Ser. No. 08/75,502 filed Jun. 10, 1993, now U.S. Pat. No. 5,392,537, which is a 371 of PCT/AU91/00590, filed Dec. 20, 1991.

BACKGROUND OF THE INVENTION

This invention relates to improvements in footwear and refers particularly, though not exclusively, to footwear of the nature shown in my earlier International Application PCT/AU91/00590 lodged 20th December 1991 and having a priority date of 20th December 1990.

It has been found in certain sports that the relatively rotatable member in the sole requires very strong resilient strength to return to the "centre" position. This is particularly important in sports where there can be strong grip between a relatively rotatable member and the playing surface. For example, in football of its varying natures, sprigs or spikes may be used to obtain better grip. If the ground is somewhat hard, and they obtain very good grip, the return force required needs to be fairly high. Also, the players can be fairly large and strong and thus fairly large and strong springs are required. Furthermore, the playing surfaces themselves are rather dirty and thus a spring under the relatively rotatable member is of great advantage.

SUMMARY OF THE INVENTION

It is therefore the principle object of the present invention to provide improvements in footwear wherein there is a recess in the sole and a turntable is mounted in the recess for a limited rotation relative to the sole, the turntable being operatively connected to the sole by a resilient means mounted between the turntable and the sole.

With the above and other objects in mind the present invention provides an article of footwear having a sole, said sole having a lower surface; a recess in said lower surface, and a turntable mounted in said recess for limited rotation relative to said sole; said turntable being operatively connected to said sole by at least one resilient means mounted between said turntable and said sole so as to cause said turntable to return to a rest position, said turntable being limited in its angular rotation relative to said sole.

BRIEF DESCRIPTION OF THE DRAWING

In order that the invention may be fully understood there shall now be described a preferred construction of an article of footwear incorporating the improvements of the present invention, the description being by way of non-limitative example only and being with reference to the accompanying illustrative drawing, FIG. 1, being an exploded perspective view.

DETAILED DESCRIPTION OF THE PREFERRED EMBODIMENT

Figure 1:
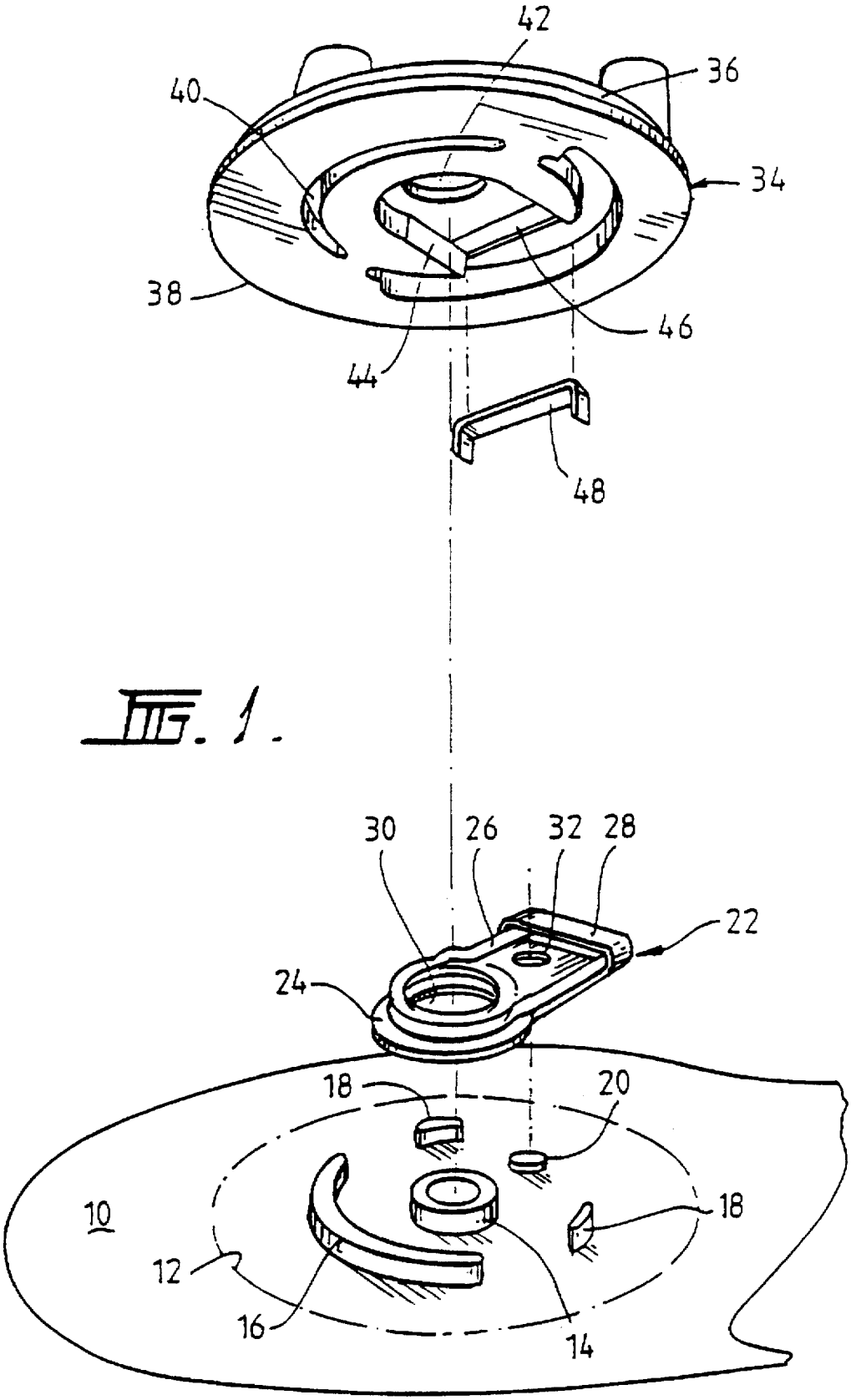

This description is with reference to U.S. application Ser. No. 08/075,502, titled FOOTWEAR WITH TURNTABLE, now U.S. Pat. No. 5,392,537, hereby incorporated by reference, and corresponding to my earlier International Application PCT/AU91/00590.

For the current invention the article of footwear has a sole generally designated as 10 and which has an undercut recess generally designated as 12 as shown in phantom in FIG. 1, the details of which are in accordance with the aforesaid International Application.

Mounted in the sole 10 within the recess 12 is a central hub 14 as well as an arcuate lug 16. Two small and substantially identical lugs 18 and a small pin 20 are also provided.

A spring module 22 having a plate 24 and a spring 26 held in place by a retaining clip 28 is provided. The spring module 22 has a large aperture 30 which is intended to pass over the hub 14. A smaller aperture 32 is intended to pass over the pin 20. The small lugs 18 locate the spring module 22 in position so that the plate 24 fits inside the arcuate lug 16 as well as the locating lugs 18. The engagement of the pin 20 in aperture 32 and hub 14 in aperture 30 accurately locates the spring module 22 in position.

The turntable is generally designated as 34 and has an upper portion 36 with there being a larger diameter lower portion 38 adapted to co-operate with the undercut recess 12. An arcuate recess 40 is provided so as to co-operate with the arcuate lug 16 both in the sense of locating the turntable 34 and limiting arcuate movement. A central opening 42 is provided in which the hub 14 can be located. Also provided is an enlarged recess 44 which accommodates the spring module 22. A further recess 46 is provided for a wearing plate 48—the wearing plate being that part which would take most of the force of movement of the turntable 44.

As can be seen, once the turntable 34, wearing plate 48, spring module 22 and sole 10 are assembled, upon rotation of the turntable 34, the sides of the recess 44 would press upon the spring 26 to thus cause tension in the spring 26 to be created. Once the pressure causing the rotation of the turntable 34 was released, it would revert to the central or neutral position under action of the spring 26.

With this form of construction, the spring module 22 is contained within the turntable 34 and thus the ingress of dirt, grit and other wear-inducing factors and performance-retarding factors will be reduced. With a spring module 22 a strong spring 26 of metal or other strong material such as a strong plastics, can be provided.

The spring module 22 should not be limited to the form shown but a spring such as a dock spring, spiral spring, leaf spring, or other form of spring or resilient means could be used.

Whilst there has been described in the foregoing description improvements in footwear in accordance with the principal features of the present invention, it will be understood by those in the technical fields concerned that many variations or modifications in details of design or construction may be made without departing from the ambit of the present invention.

What is claimed is:

1. An article of footwear having a sole, said sole having a lower surface, a recess in said lower surface, and a turntable mounted in said recess for limited rotation relative to said sole in each direction of rotation from a rest position; said turntable being operatively connected to said sole by at least one resilient structure mounted between said turntable and said sole so as to cause said turntable to return to said rest position, said turntable being limited in its angular rotation relative to said sole.

2. An article of footwear as claimed in claim 1, wherein said recess has a central hub projecting outwardly therefrom; and, concentric with said central hub, an arcuate lug projecting downwardly from said recess.

3. An article of footwear as claimed in claim 2, wherein said recess also has two small lugs equidistant from said hub projecting downwardly therefrom.

4. An article of footwear as claimed in claim 1, wherein said recess has an undercut into said sole so as to assist with the retention of said turntable in said recess.

5. An article of footwear as claimed in claim 2, wherein said turntable has an upper portion, and a lower portion adapted to engage in said recess, said lower portion having an arcuate recess adapted to cooperate with said arcuate lug to locate said turntable in said recess and to limit said angular rotation of said turntable.

6. An article of footwear as claimed in claim 5, wherein said turntable has central opening through which said central hub passes; and an enlarged recess in which is located said resilient structure, said enlarged recess having sides which act upon said resilient structure upon rotation of said turntable.

7. An article of footwear as claimed in claim 5, wherein said turntable has a wearing plate located in a further recess.

8. An article of footwear as claimed in claim 2, wherein said resilient structure comprises a spring module; said spring module comprising a plate, a wound spring on said plate, and a retaining clip to retain said wound spring on said plate.

9. An article of footwear as claimed in claim 8, wherein said plate has a large aperture through which passes said central hub, and a small aperture through which passes a pin projecting outwardly from said recess.

10. An article of footwear as claimed in claim 6, wherein said turntable has a wearing plate located in a further recess.

* * * * *